US008801985B2

(12) United States Patent
Ikeda et al.

(10) Patent No.: US 8,801,985 B2
(45) Date of Patent: Aug. 12, 2014

(54) PROCESS OF MAKING A CARBON FIBER PRECURSOR FIBER BUNDLE

(75) Inventors: Katsuhiko Ikeda, Otake (JP); Atsushi Kawamura, Otake (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 694 days.

(21) Appl. No.: 13/082,221

(22) Filed: Apr. 7, 2011

(65) Prior Publication Data

US 2012/0066866 A1 Mar. 22, 2012

Related U.S. Application Data

(62) Division of application No. 10/589,189, filed as application No. PCT/JP2005/002038 on Feb. 10, 2005, now Pat. No. 7,941,903.

(30) Foreign Application Priority Data

Feb. 13, 2004 (JP) ..... 2004-037410

(51) Int. Cl.

| | |
|---|---|
| ***D01D 5/06*** | (2006.01) |
| ***B65H 54/76*** | (2006.01) |
| ***D01D 5/16*** | (2006.01) |
| ***D01D 7/00*** | (2006.01) |
| ***D01F 6/18*** | (2006.01) |
| ***D02J 1/08*** | (2006.01) |
| ***D02J 1/22*** | (2006.01) |

(52) U.S. Cl.

CPC ..... *B65H 54/76* (2013.01); *D01D 5/16* (2013.01); *D01D 7/00* (2013.01); *D01F 6/18* (2013.01); *D02J 1/08* (2013.01); *D02J 1/223* (2013.01); *D02J 1/228* (2013.01)

USPC ..... 264/103; 28/271; 264/182; 264/210.3; 264/210.7; 264/210.8; 264/211.12; 264/211.14; 264/211.15

(58) Field of Classification Search

CPC ..... B65H 54/76; D01D 5/06; D01D 5/16; D01D 7/00; D01F 6/18; D02J 1/08; D02J 1/223; D02J 1/228

USPC ..... 264/103, 129, 130, 182, 184, 203, 264/178 F, 210.3, 210.7, 210.8, 211.12, 264/211.14, 211.15; 28/271, 289

See application file for complete search history.

(56) References Cited

U.S. PATENT DOCUMENTS

| | | | |
|---|---|---|---|
| 3,110,151 A | 11/1963 | Bunting, Jr. et al. | |
| 3,339,362 A | 9/1967 | Dodson, Jr. et al. | |

(Continued)

FOREIGN PATENT DOCUMENTS

| | | | |
|---|---|---|---|
| EP | 1 306 470 A1 | 5/2003 | |
| JP | 03161505 A * | 7/1991 | ..... 264/182 |

(Continued)

OTHER PUBLICATIONS

International Search Report issued May 24, 2005 in PCT/JP2005/002038 filed Feb. 10, 2005.

(Continued)

*Primary Examiner* — Leo B Tentoni

(74) *Attorney, Agent, or Firm* — Oblon, Spivak, McClelland, Maier & Neustadt, L.L.P.

(57) ABSTRACT

A production method for a carbon fiber precursor fiber bundle and a production apparatus of the carbon fiber precursor fiber bundle. A carbon fiber precursor fiber bundle that has a degree of intermingle of 1 m−1 or less between small tows, consists of substantially straight fibers without imparted crimp, a tow of which straight fibers has a moisture content of less than 10% by mass when housed in a container, and has a widthwise dividing capability to maintain a form of a single aggregate of tows when housed in a container, taken out from the container and guided into a firing step, and to divide into a plurality of small tows in the firing step by the tension generated in the firing step.

11 Claims, 8 Drawing Sheets

(56) References Cited

U.S. PATENT DOCUMENTS

| | | | | | |
|---|---|---|---|---|---|
| 3,474,613 | A | | 10/1969 | Joarder et al. | |
| 3,535,755 | A | | 10/1970 | Brown | |
| 3,541,075 | A | * | 11/1970 | Baur et al. | 264/182 X |
| 3,543,358 | A | * | 12/1970 | Breen et al. | 28/271 X |
| 3,581,486 | A | | 6/1971 | Dibble | |
| 3,898,719 | A | | 8/1975 | Lloyd | |
| 3,997,638 | A | * | 12/1976 | Manning et al. | 264/182 X |
| 4,070,815 | A | | 1/1978 | Negishi et al. | |
| 4,081,887 | A | * | 4/1978 | Holden | 28/271 |
| 4,124,924 | A | | 11/1978 | Phillips et al. | |
| 4,466,949 | A | | 8/1984 | Mori | |
| 4,644,620 | A | | 2/1987 | Maeda | |
| 4,644,622 | A | | 2/1987 | Bauer et al. | |
| 4,714,642 | A | | 12/1987 | McAliley et al. | |
| 4,913,869 | A | * | 4/1990 | Funk | 264/182 |
| 4,949,441 | A | | 8/1990 | Ethridge | |
| 6,131,785 | A | * | 10/2000 | Anderson et al. | 28/289 X |
| 6,187,434 | B1 | | 2/2001 | Arai et al. | |
| 6,245,423 | B1 | | 6/2001 | Ikeda et al. | |
| 6,294,252 | B1 | | 9/2001 | Yamanaka et al. | |
| 6,485,592 | B1 | | 11/2002 | Yoshimura et al. | |
| 6,485,595 | B1 | | 11/2002 | Yenni, Jr. et al. | |
| 6,503,624 | B2 | | 1/2003 | Ikeda et al. | |
| 6,610,403 | B1 | | 8/2003 | Kasabo et al. | |
| 6,641,915 | B1 | | 11/2003 | Kasabo et al. | |
| 6,696,156 | B2 | | 2/2004 | Kasabo et al. | |
| 6,733,881 | B2 | | 5/2004 | Kasabo et al. | |
| 6,868,593 | B1 | | 3/2005 | Mitsuhashi et al. | |
| 7,155,890 | B2 | | 1/2007 | Kawamura et al. | |
| 2004/0155377 | A1 | | 8/2004 | Kasabo et al. | |

FOREIGN PATENT DOCUMENTS

| | | | |
|---|---|---|---|
| JP | 10 121325 | | 5/1998 |
| JP | 10-226918 | | 8/1998 |
| JP | 11 189913 | | 7/1999 |
| JP | 2000 345435 | | 12/2000 |
| JP | 2001 181925 | | 7/2001 |
| JP | 2001 355121 | | 12/2001 |
| JP | 2002-13022 | A | 1/2002 |
| JP | 2002-20927 | A | 1/2002 |
| JP | 2002-220726 | | 8/2002 |
| JP | 2004-100132 | | 4/2004 |

OTHER PUBLICATIONS

Supplementary EuropeanSearch Report issued Nov. 7, 2007 in European Application No. 05 71 00 90 filed Feb. 10, 2005.

* cited by examiner

PROCESS OF MAKING A CARBON FIBER PRECURSOR FIBER BUNDLE

This application is a divisional of U.S. Ser. No. 10/589,189 filed Aug. 11, 2006, now U.S. Pat. No. 7,941,903, which is a National Stage of PCT/JP05/02038 filed Feb. 10, 2005.

TECHNICAL FIELD

The present invention relates to a carbon fiber and a production method thereof. The present invention also relates to a carbon fiber precursor fiber bundle to be used for production of a carbon fiber, and a production method and a production apparatus thereof.

BACKGROUND ART

As an acrylonitrile-based precursor fiber for a carbon fiber, for the purpose of obtaining a carbon fiber having high strength and high elasticity modulus, predominantly a so-called small tow of 3,000 to 20,000 filaments which tow scarcely suffers filament breaking and fluff generation and is excellent in quality has hitherto been produced; a carbon fiber produced from such a precursor fiber has been used in various fields such as the aerospace field and the sport field.

A precursor fiber for producing a carbon fiber is subjected to a flame retarding treatment in which, in advance of carbonization, the precursor fiber is heated in an oxidative atmosphere set at 200 to 350° C. The flame retarding treatment generates a reaction heat, and hence heat tends to be stored inside the fiber tow. When excessive heat storage occurs inside the fiber tow, yarn breaking and fusion bonding between fibers tend to be generated. Accordingly, it is necessary to suppress the heat storage due to the reaction heat as much as possible. For the purpose of suppressing the heat storage, the thickness of the fiber tow fed to a flame retarding oven is inevitably made to be equal to or less than a certain thickness; thus, a constraint is imposed on the thickness of the fiber tow, and accordingly constitutes factors that degrade the productivity and simultaneously raises the production cost.

For the purpose of solving the above described problems, for example, Patent Document 1 (Japanese Patent Laid-Open No. 10-121325) discloses a precursor fiber tow for a carbon fiber which tow maintains a form of a tow when housed in a container, but has a widthwise dividing capability to divide the tow into a plurality of small tows when the tow is taken out, from the container, to be used. For the purpose of producing the fiber tow having this dividing capability, a plurality of spun yarns (fibers) are divided into a plurality of groups each having a predetermined number of yarns, and the plurality of groups are made to travel parallel in this divided condition, made to pass through a fiber-making step and a finishing oiling agent imparting step, and transferred to a crimp imparting step involving a crimper. The crimp imparting carries out bundling of a predetermined number of the plurality of groups into a form of a tow. When the crimp imparting step is not applied, individual small tows each are made to contain water in a content of 10% or more and 50% or less.

In the bundled form, the yarns at the selvage of each of the yarn groups, each having a small tow form, are made to obliquely cross each other over approximately 1 mm to be mutually weakly intermingled, and thus, a single tow form made of a plurality of yarn groups is maintained. The intermingle based on the oblique crossing of the yarns at the selvage of each of the yarn groups is weak, and hence, when the bundled form is transferred to and used in a carbon fiber producing step after having been maintained in a single tow form, easy division into individual yarn groups from the selvage is made possible, and the bundled fiber bundle is housed in a container as it is in a condition capable of being divided into small tows.

The precursor fiber bundle, having dividing capability, for a carbon fiber housed in a container are divided into the above described individual small tows in a dividing step before being guided into the flame retarding oven. This division is to be carried out, for example, by using a grooved roll or a dividing guide bar. The small tows are mutually bundled by being weakly intermingled at the selvages thereof, and hence this division can be extremely easily carried out in such a way that breakage or fuzz generation scarcely occurs. The individual tows divided into small tow forms each having a predetermined size or less are guided into the flame retarding step to be subjected to the flame retarding treatment. In this treatment, it is stated that the small tows are subjected to the flame retarding treatment as they are in the divided condition, so that the excess heat storage is not generated, and accordingly the breakage or the fusion bonding between filaments is prevented.

The mechanism for imparting the bundled fiber bundle the dividing capability into small tows, according to above described Patent Document 1, is stated to be based on the intermingling due to oblique crossing of each fiber located at the selvages of the small tows; however, with a degree of intermingle of 1 to 10 $m^{-1}$ at the dividing portions in the small tows, when division into small tows is carried out by a dividing means in advance of being guided into the flame retarding step, single yarn breaking is possibly caused and the quality of the carbon fiber is possibly affected thereby. Furthermore, in Patent Document 1, as means for intermingling small tows with each other, there is disclosed only a method that is based on the imparting of the crimp where a form of a tow is maintained by crossing the yarns at the selvages of the individual small tows obliquely with each other to weakly intermingle the yarns. In the case of such a crimped tow, when the crimped tow is guided as it is into the flame retarding step involved in a production process of a carbon fiber, it is difficult to uniformly straighten the crimps over the whole range of the tow to provide a predetermined elongation. Consequently, there may occur unevenness in the basis weight (weight per unit length) and the fineness of the obtained carbon fiber, and the quality of the obtained carbon fiber is possibly thereby affected. Under these circumstances, a crimp removing means is required in advance of the flame retarding step, which increases the equipment space, impedes work saving and significantly affects the productivity.

On the other hand, in aforementioned Patent Document 1, for the case of a form of a straight tow without imparted crimp, it is only described that the moisture percentage thereof is from 10 to 50%. In other words, there is described only a mechanism that the surface tension due to the moisture bundles the small tows to maintain a form of a single tow. With such moisture percentage, the surface tension due to the water within the tow serves to maintain the bent shape formed when folded and housed in a container, and consequently when fed to the production step of the carbon fiber, the tow is fed as it still has the bent shape and the oblique disposition of the filaments within the tow caused by the bent shape, the quality of the obtained carbon fiber is impaired, or sometimes the bent shape turns into twisted shape, and there is a fear that excessive heat storage is caused in such twisted portion in the flame retarding step.

Furthermore, irrespective as to whether or not a bundled fiber bundle is made to pass through a crimper, the bundled fiber bundle is required to be divided into small tows each having a predetermined thickness before the bundled fiber bundle is guided into a firing step after the bundle is taken out from a container; thus, a dividing device is required to be installed purposely, which increases the equipment space, impedes work saving and significantly affects the productivity.

Application of carbon fiber is being expanding over common industrial fields including automobiles, civil engineering, construction and energy. Accordingly, there are strong demands for supply of large tow carbon fiber high in strength, high in elastic modulus, high in grade and high in quality as well as large tow carbon fiber lower in price and excellent in productivity. For example, Patent Documents 2 and 3 disclose production methods of a large tow carbon fiber and a carbon fiber precursor fiber bundle; however, the carbon fiber disclosed in either of these Documents does not attain strength to a sufficient extent, and as affairs now stand, does not reach the strand strength and the elastic modulus comparable to those of a conventional small tow having the number of filaments of 12,000 or less.

Patent Document 1: Japanese Patent Laid-Open No. 10-121325

Patent Document 2: Japanese Patent Laid-Open No. 11-189913

Patent Document 3: Japanese Patent Laid-Open No. 2001-181925

DISCLOSURE OF THE INVENTION

Problems to be Solved by the Invention

An object of the present invention is to provide a carbon fiber precursor fiber bundle which permits bundling of a plurality of small tows into a bundled fiber bundle by a simple operation, is provided with a dividing capability to divide into the original small tows spontaneously in a firing step, is low in production cost, is excellent in productivity, scarcely suffers yarn breaking and fuzz generation, and is suitable for obtaining a carbon fiber that is high in grade, high in quality and excellent in strength attainment, and a production method and a production apparatus of the carbon fiber precursor fiber bundle.

Another object of the present invention is to provide such an excellent carbon fiber and a production method thereof.

Means for Solving the Problems

The present invention is as described below.

1) A carbon fiber precursor fiber bundle, characterized by:

having 1 $m^{-1}$ or less of a degree of intermingle between a plurality of small tows based on the hook drop method;

consisting of substantially straight fibers without imparted crimp, a tow of which straight fibers has a moisture content of less than 10% by mass when housed in a container; and having a widthwise dividing capability to maintain a form of a single aggregate of tows when housed in a container, taken out from the container and guided into a firing step, and to divide into a plurality of small tows in the firing step by the tension generated in the firing step.

2) The carbon fiber precursor fiber bundle according to 1), wherein the monofilament fineness is 0.7 dtex or more and 1.3 dtex or less, the number of monofilaments of the small tow is 50000 or more and 150000 or less, and the total number of monofilaments in the aggregate of tows is 100000 or more and 600000 or less.

3) The carbon fiber precursor fiber bundle according to 1) or 2), wherein the aggregate of tows is formed by intermingling monofilaments between a widthwise end of a small tow and a widthwise end of the adjacent small tow by air flow.

4) The carbon fiber precursor fiber bundle according to any one of 1) to 3), wherein the number of monofilaments undergoing adhesion between the monofilaments is 5 per 50,000 of monofilaments or less and the size of the crystal region in a direction perpendicular to the fiber axis is $1.1\times10^{-8}$ m or more.

5) The carbon fiber precursor fiber bundle according to any one of 1) to 4), wherein the strength of a monofilament is 5.0 cN/dtex or more, and the fineness unevenness (CV value) of the monofilament is 10% or less.

6) The carbon fiber precursor fiber bundle according to any one of 1) to 5), wherein the oiling agent adhesion unevenness (CV value) along the lengthwise direction is 10% or less.

7) A production method of a carbon fiber precursor fiber bundle, characterized by including:

a coagulation step of forming swollen yarn by extruding an organic solvent solution of an acrylonitrile-based polymer into an aqueous solution of dimethylacetamide from a spinning nozzle having a nozzle hole diameter of 45 μm or more and 75 μm or less and the number of holes of 50,000 or more at a coagulated yarn take-up speed/extrusion linear speed ratio of 0.8 or less;

a wet heat drawing step of wet heat drawing the swollen yarn;

an oiling agent imparting step of imparting a first oiling agent to the wet heat drawn yarn by guiding the wet heat drawn yarn into a first oil bath, and subsequently imparting a second oiling agent in a second oil bath after once squeezing the yarn by use of two or more guides;

a small tow production step of obtaining a small tow by drying, densifying and secondarily drawing the yarn imparted with the first and second oiling agents so as to have a total drawing magnification of 5 or more and 10 or less; and an aggregate-of-tows production step of obtaining an aggregate of tows by feeding a plurality of the small tows so as to be in parallel and adjacent to each other into an intermingling device that includes a yarn channel having a flat rectangular section and a plurality of air jet holes which are disposed with a predetermined interval along the long side direction of the flat rectangle and which open into the yarn channel, and by jetting out air from the air jet holes to intermingle the adjacent small tows with each other.

8) The production method of a carbon fiber precursor fiber bundle according to 7), further including an aggregate-of-tows housing step of housing the aggregate of tows in a container after the aggregate-of-tows production step and a water imparting step of imparting water to the small tows before the aggregate-of-tows production step, wherein the water content of the aggregate of tows in the aggregate-of-tows housing step is set at less than 10% by mass.

9) The production method of a carbon fiber precursor fiber bundle according to 7) or 8), further including, before the aggregate-of-tows production step, an intra-small-tow intermingling step of intermingling monofilaments within the small tow with each other by passing the small tow through an intermingling device, other than the intermingling device used in the aggregate-of-tows production step, that includes a yarn channel having a circular section and an air jet hole which opens into this yarn channel, and by jetting out air from this air jet hole.

10) The production method of a carbon fiber precursor fiber bundle according to 7) or 8), further including, before the aggregate-of-tows production step, an intra-small-tow intermingling step of intermingling monofilaments within the small tow with each other by passing the small tow through an intermingling device, other than the intermingling device used in the aggregate-of-tows production step, that includes a yarn channel having a flat rectangular section and a plurality of air jet holes which are disposed with a predetermined interval along the long side direction of this flat rectangle and which open into this yarn channel, and by jetting out air from these air jet holes.

11) The production method of a carbon fiber precursor fiber bundle according to 7) or 8), wherein monofilaments within the small tow are intermingled with each other in the aggregate-of-tows production step.

12) The production method of a carbon fiber precursor fiber bundle according to 11), wherein the intermingling device, used in the aggregate-of-tows production step, further includes a groove which extends along the lengthwise direction of the yarn channel and which opens into the yarn channel at a position where the small tows are adjacent to each other.

13) The production method of a carbon fiber precursor fiber bundle according to 9) or 10), wherein:

the intermingling device, used in the aggregate-of-tows production step, further includes a groove which extends along the lengthwise direction of the yarn channel and which opens into the yarn channel at a position where the small tows are adjacent to each other, and the air jet holes open only into the groove; and a plurality of the small tows are intermingled with each other, wherein the filaments within the small tows are intermingled with each other, by feeding to this intermingling device the plurality of the small tows having been subjected to the intra-small-tow intermingling step.

14) The production method of a carbon fiber precursor fiber bundle according to any one of 7) to 13), further including a step of housing in a container the aggregate of tows obtained in the aggregate-of-tows production step after the aggregate of tows has been fed to a gear roll.

15) The production method of a carbon fiber precursor fiber bundle according to any one of 7) to 13), further including a step of housing in a container the aggregate of tows obtained in the aggregate-of-tows production step after the aggregate of tows has been fed to a nip roll.

16) A production apparatus of a carbon fiber precursor fiber bundle, characterized by including an intermingling device that includes a yarn channel having a flat rectangular section capable of passing a plurality of small tows which are adjacent to each other and that includes a plurality of air jet holes which are disposed with a predetermined interval along the long side direction of the flat rectangle and which open into the yarn channel.

17) The production apparatus of a carbon fiber precursor fiber bundle according to 16), further including a groove which extends along the lengthwise direction of the yarn channel and which opens into the yarn channel at a position where the plurality of small tows are adjacent to each other.

18) A production apparatus of a carbon fiber precursor fiber bundle, characterized by including:

a first intermingling device that includes a yarn channel having a circular section capable of passing a small tow and that includes one or more air jet holes for jetting out air into the yarn channel; and a second intermingling device that includes a yarn channel having a flat rectangular section capable of passing a plurality of small tows which are adjacent to each other and that includes a plurality of air jet holes which are disposed with a predetermined interval along the long side direction of this flat rectangle and which open into this yarn channel.

19) A production apparatus of a carbon fiber precursor fiber bundle, characterized by including:

a first intermingling device that includes a yarn channel having a flat rectangular section capable of passing a small tow and that includes one or more air jet holes for jetting out air into the yarn channel; and a second intermingling device that includes a yarn channel having a flat rectangular section capable of passing a plurality of small tows which are adjacent to each other and that includes a plurality of air jet holes which are disposed with a predetermined interval along the long side direction of this flat rectangular shape and which open into this yarn channel.

20) The production apparatus of a carbon fiber precursor fiber bundle according to 18) or 19), wherein the second intermingling device further includes a groove which extends along the lengthwise direction of the yarn channel thereof and which opens into the yarn channel at a position where the plurality of small tows are adjacent to each other.

21) The production apparatus of a carbon fiber precursor fiber bundle according to 20), wherein the air jet holes of the second intermingling device open only into the groove.

22) The production apparatus of a carbon fiber precursor fiber bundle according to 16), wherein the ratio $n \cdot D/L$ of the total fineness nD (dTex) of an aggregate of tows represented by the product between the total fineness D (dTex) of the small tow and the number n of the small tows to be aggregated to the long side dimension L (mm) of the flat rectangular section is 2000 dTex/mm or more and 12,000 dTex/mm or less, and the diameter of each of the air jet holes is 0.3 mm or more and 1.2 mm or less.

23) The production apparatus of a carbon fiber precursor fiber bundle according to 16), wherein the air jet holes are disposed with an even pitch, and the pitch is 0.8 mm or more and 1.6 mm or less, and the length of the yarn channel is 10 mm or more and 40 mm or less.

24) The production apparatus of a carbon fiber precursor fiber bundle according to 17) or 20), wherein the groove has a sectional shape of a part of a circle, and the diameter of the circle is 2 mm or more and 10 mm or less, and the depth of the groove is 1.5 mm or more and 4 mm or less.

25) The production apparatus of a carbon fiber precursor fiber bundle according to 17) or 20), wherein the groove has a trapezoidal sectional shape, and the dimension of the long side of the trapezoidal groove section is 2 mm or more and 10 mm or less, and the dimension of the short side corresponding to groove bottom is 1.5 mm or more and 6 mm or less.

26) A production method of a carbon fiber, characterized in that the carbon fiber precursor fiber bundle according to any one of aforementioned 1) to 6) is fed to a flame retarding step, and is fired while being divided into small tows by the tension generated in the flame retarding step.

27) A production method of a carbon fiber, characterized in that the carbon fiber precursor fiber bundle according to any one of aforementioned 1) to 6) is fed to a carbonization step after a flame retarding step, and is fired while being divided into small tows by the tension generated in the carbonization step.

28) A carbon fiber characterized in that the carbon fiber is produced by the method according to 27) and the strand strength thereof defined by JIS R7601-1986 is 4100 MPa or more.

29) A production method of a carbon fiber precursor fiber bundle, characterized by including a step of obtaining a single aggregate of tows by disposing a plurality of small tows of carbon fiber precursor fiber so as to be in parallel and adjacent to each other, and by intermingling the adjacent small tows with each other by air flow.

30) The production method of a carbon fiber precursor fiber bundle according to 29), wherein, in the step of obtaining an aggregate of tows, the intermingling is carried out by feeding a plurality of the small tows so as to be in parallel and adjacent to each other into an intermingling device that includes a yarn channel having a flat rectangular section and a plurality of air jet holes which are disposed with a predetermined interval along the long side direction of the flat rectangle and which open into the yarn channel, and by jetting out air from the air jet holes.

Advantages of the Invention

The carbon fiber precursor fiber bundle (aggregate of tows) of the present invention can be easily divided into small tows when subjected to a flame retarding treatment, and hence the heat storage in the fiber bundle can be easily suppressed. Consequently, no constraint is imposed on the thickness of the fiber bundle to be fed to the flame retarding treatment. Accordingly, there can be obtained a carbon fiber excellent in productivity and low in production cost.

As described above, the fiber bundle is capable of being divided, and hence yarn breaking or fuzz generation is not induced, and the grade and quality of the carbon fiber are not damaged. Accordingly, the use of such a precursor fiber bundle makes it possible to obtain a carbon fiber that scarcely suffers yarn breaking or fuzz generation, is high in grade, is high in quality, and is particularly excellent in attainment of strength.

According to the production method of a carbon fiber precursor fiber bundle of the present invention, there can be suitably produced the above described small tow or an aggregate of tows. According to the production method of a carbon fiber of the present invention, there can be suitably produced such an excellent carbon fiber as described above.

The use of the production apparatus of a carbon fiber precursor fiber bundle of the present invention makes it possible to suitably produce the above described aggregate of tows.

DESCRIPTION OF SYMBOLS

Figure 1:
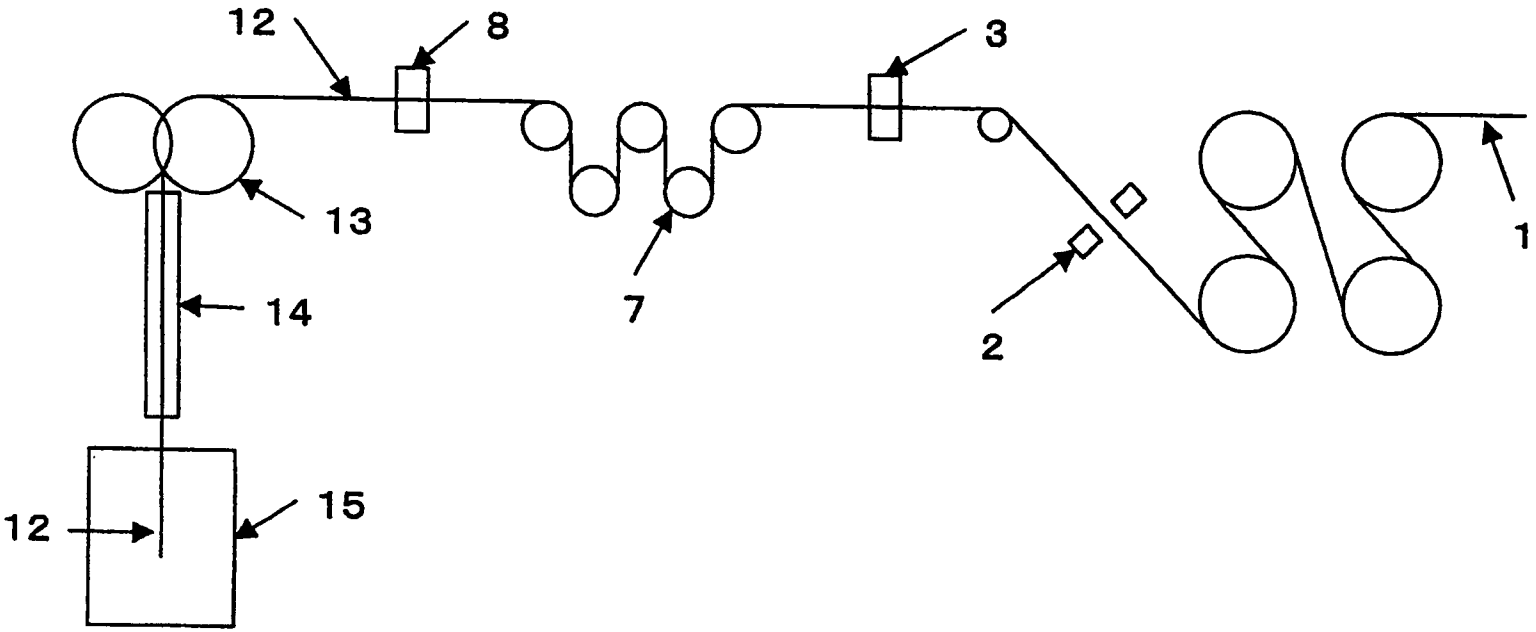
FIG. 1 is a schematic process drawing illustrating an example of a production process of a carbon fiber precursor fiber bundle in which process intermingling is carried out by air jet.

1: small tow
2: spray
3: first intermingling device
4, 9, 20, 21, 26: yarn channel
5: upper nozzle
6: lower nozzle
5*a*, 6*a*, 10*a*, 11*a*: compressed air introduction part
5*b*, 6*b*, 10*b*, 11*b*, 18*b*, 19*b*, 22*b*, 23*b*, 27*b*, 28*b*: air jet hole
7: driving roll
8, 17, 24, 25: second intermingling device
12: aggregate of tows
13: gear roll
14: chute
15: container
16: touch roll
18*c*, 19*c*, 22*c*, 23*c*, 27, 28*c*: groove
30: roundness R at an angular groove portion

BEST MODE FOR CARRYING OUT THE INVENTION

The above described problems can be solved by a carbon fiber precursor fiber bundle of the present invention that has 1 $m^{-1}$ or less of a degree of intermingle between a plurality of small tows based on the hook drop method, that consists of substantially straight fibers without imparted crimp, a tow of which straight fibers has a moisture content of less than 10% by mass when the tow is housed in a container, and that has a widthwise dividing capability to maintain a form of a single aggregate of tows when housed in a container, taken out from the container and guided into a firing step, and to divide into a plurality of small tows in the firing step by the tension generated in the firing step.

The carbon fiber precursor fiber bundle of the present invention maintains a form of a single tow as a mutual aggregate of a plurality of small tows without impairing the grade thereof, and can be divided, without entangling between small tows, due to the tension generated when fired without installing a dividing guide or the like, while maintaining a form of a single tow when taken out from a container.

In the carbon fiber precursor fiber bundle, the monofilament fineness is preferably 0.7 dtex or more and 1.3 dtex or less, the total number of filaments is preferably 100000 or more and 600000 or less, and the number of filaments in each of the small tows is preferably 50000 or more and 150000 or less. When the monofilament fineness is 0.7 dtex or more, it is easy to stably spin a stock yarn, for a carbon fiber precursor fiber, such as an acrylic fiber yarn. When the monofilament fineness is 1.3 dtex or less, a high performance carbon fiber can be obtained while the sectional double structure is suppressed so as not to be remarkable. When the total number of filaments in the carbon fiber precursor fiber bundle is 100000 or more, firing can be carried out with an excellent productivity while suppressing a possibility of the decrease in the number of the actually fired small tows in the firing step. When the total number of filaments in the carbon fiber precursor fiber bundle is 600000 or less, it is easy to house a carbon fiber precursor fiber bundle having a desired length in a container. When the number of filaments of a small tow is 50000 or more, there can be suppressed a possibility that an increased division number impedes the attainment of the dividing capability in the firing step, and there can also be suppressed a possibility that the forming efficiency is lowered because the small tow is thin. When the number of filaments of a small tow is 150000 or less, the heat storage due to the reaction heat can be suppressed in the flame retarding step, and generation of yarn breaking, fusion bonding or the like can be excellently suppressed.

The number of the adhered monofilaments is preferably as small as possible, from the viewpoint of suppressing the generation of fuzz, bundle breakage and the like in the subsequent flame retarding step, pre-carbonization step and carbonization step due to the adhesion between the monofilaments, and from the viewpoint of preventing the degradation of the strand strength. From these viewpoints, the number of the monofilaments undergoing adhesion between the monofilaments, constituting a carbon fiber precursor fiber bundle, is preferably 5 per 50000 of monofilaments or less. And the size of the crystal region in a direction perpendicular to the fiber axis is preferably 110 Å ($1.1\times10^{-8}$ m) or more.

The monofilament strength of the carbon fiber precursor fiber bundle is preferably 5.0 cN/dtex or more, more preferably 6.5 cN/dtex or more, and furthermore preferably 7.0 cN/dtex or more. When the monofilament strength is 5.0 cN/dtex or more, there can be excellently prevented a possibility that increased occurrence frequency of fuzz generation due to single yarn breaking in the firing step degrades the firing step passage performance, and thus a carbon fiber excellent in strength can be obtained.

The fineness unevenness (CV value) of the monofilaments constituting the precursor fiber bundle is preferably 10% or less, more preferably 7% or less, and furthermore preferably 5% or less. When this value is 10% or less, there can be excellently prevented yarn breaking and twining trouble in the spinning step and the firing step.

The oiling agent adhesion unevenness (CV value) of the precursor fiber bundle along the lengthwise direction is preferably 10% or less, and more preferably less than 5%. When this value is 10% or less, generation of adhesion and fusion bonding can be excellently prevented in the spinning step, and consequently, troubles such as single yarn breaking or bundle breakage can be excellently prevented. The oiling agent adhesion unevenness falling within the above described range is preferable for the carbon fiber to be obtained from the view points of the quality and performances (particularly, strand strength). For the purpose of obtaining a high-quality and high-performance carbon fiber precursor yarn bundle and a high-quality and high-performance carbon fiber, it is preferable to make an oiling agent to adhere as evenly as possible irrespective of the total fineness of a small tow or a large tow.

According to the present invention, a carbon fiber precursor fiber bundle can be obtained by obtaining an aggregate of tows by disposing a plurality of the small tows of the carbon fiber precursor fiber so that the small tows are in parallel and adjacent to each other, an by carrying out confounding between the adjacent tows using air flow. According to this method, there can be formed an aggregate of tows, without imparting crimp thereto, provided with a dividing capability to divide the aggregate into the original small tows spontaneously in the firing step (flame retarding step, carbonization step).

When obtaining an aggregate of tows, the confounding may be carried out by feeding the plurality of the small tows, so that the small tows are in parallel and adjacent to each other, into an intermingling device that includes a yarn channel having a flat rectangular section and a plurality of air jet holes which are disposed with a predetermined interval along the long side direction of the flat rectangle and which open into the yarn channel, and by jetting out air from the air jet holes.

The carbon fiber precursor fiber bundle of the present invention may be produced, for example, by the following method. That is, a spinning solution consisting of an acrylonitrile-based polymer and an organic solvent is extruded into an aqueous solution of dimethylacetamide from a spinning nozzle having a nozzle hole diameter of 45 μm or more and 75 μm or less and the number of holes of 50,000 or more at a "coagulated yarn take-up speed/extrusion linear speed" ratio of 0.8 or less, and thus a swollen yarn is obtained. When the number of the holes is 50000 or more, the productivity can be made excellent. The number of the holes is preferably 150000 or less from the viewpoint of suppressing generation of yarn breaking, fusion bonding or the like, due to the heat storage based on the reaction heat, in the flame retarding step and further from the viewpoint of enabling the downsizing of the spinning nozzle pack and thereby increasing the number of production spindles per an apparatus.

When the "coagulated yarn take-up speed/extrusion linear speed" ratio is 0.8 or less, yarn breaking from the nozzle can be prevented to facilitate stable spinning. This ratio is preferably 0.2 or more from the viewpoint of performing uniform coagulation and thereby suppressing generation of fineness unevenness.

Subsequently, the swollen yarn is wet heat drawn, then guided into a first oil bath to be imparted with a first oiling agent, once squeezed by use of two or more guides, subsequently imparted with a second oiling agent in a second oil bath, and then dried, densified and secondarily drawn so as to have a total drawing magnification of 5 or more and 10 or less; and thus an acrylonitrile-based precursor fiber bundle can be obtained. It is to be noted that the total drawing magnification means a drawing magnification attained by all the drawing operations applied in the course of obtaining a precursor fiber bundle from a spinning solution; thus, in the above described case where solely applied are a wet heat drawing and a secondary drawing, the total drawing magnification means the product of the magnifications involved in these two drawings.

Examples of the organic solvent for the acrylonitrile-based polymer to be used in the spinning solution include dimethylacetamide, dimethylsulfoxide and dimethylformamide. Among these, dimethylacetamide is preferably used because it scarcely deteriorates due to hydrolysis of the solvent and gives excellent spinning properties.

As the spinneret for extruding a spinning solution, there may be used a spinneret having nozzle holes of 45 μm or more and 75 μm or less in hole diameter which spinneret is suitable for producing a monofilament of an acrylonitrile-based polymer of 0.7 dtex or more and 1.3 dtex or less in monofilament fineness. The use of such a nozzle small in hole diameter makes it easy to reduce (to 0.8 or less) the ratio of (the coagulated yarn take-up speed)/(the extrusion linear speed of the spinning solution from the nozzle), and to maintain excellent spinning properties.

A swollen yarn taken out from a coagulation bath is made higher in fiber orientation by a subsequent wet heat drawing. The wet heat drawing is carried out by drawing in hot water a swollen fiber bundle which is in a swollen state.

The degree of swelling of the swollen fiber bundle, after application of wet heat swelling and before drying, is preferably made to be 100% by mass or less. The fact that the degree of swelling of the swollen fiber bundle, after application of wet heat swelling and before drying, is 100% by mass or less means that the surface part and the interior part of the fiber undergo uniform orientation. After the coagulation of a coagulated yarn in a coagulation bath is made uniform by decreasing "the coagulated yarn take-up speed/the extrusion linear speed of a spinning solution from the nozzle" in the production of a coagulated yarn in a coagulation bath, the coagulated yarn is wet heat drawn, and thus uniform orientation can be attained even inside the yarn. In this way, the degree of swelling of the fiber bundle before drying can be made to be 100% by mass or less.

According to the present invention, in a production method of a carbon fiber precursor fiber bundle, there can be obtained a fiber bundle that maintains a form of a single aggregate of tows, by imparting mutual confounding between the filaments in each of small tows and the mutual bundling property between the small tows through carrying out by air jet the mutual confounding of the filaments in each of the small tows and the mutual confounding of the small tows. In this case, the widthwise ends of each of the small tows are preferably mutually intermingled to thereby maintain a tow form. The confounding between the small tows is preferably weaker than the confounding between the filaments in each of the small tows. Further, in this case, the widthwise ends of the small tows are not necessarily required to overlap with each other, but the widthwise ends of the small tows are preferably adjacent to each other so as to be in contact with each other.

In the present invention, water is imparted if needed, and when placed in a predetermined vessel, the moisture content of each of the small tows is preferably set at less than 10% by mass, and more preferably at 0.5% by mass or more and 5% by mass or less. By setting the imparted water content at 0.5% by mass or more, static electricity generation can be suppressed and the handlability can thereby be made excellent. By setting the imparted water content at less than 10% by mass, it becomes possible to eliminate a phenomenon that the tow width is made unstable by the remaining bent shape of the folding portion of the tow which bent shape has been formed by the weight of the tow itself at the time of housing or by being housed in the container in a state compressed by a press, and at the same time, the transport efficiency is increased and the economical efficiency is thereby increased.

Such a carbon fiber precursor as described above may be produced by a production method of a carbon fiber precursor fiber bundle including an aggregate-of-tows production step in which a plurality of small tows are joined together by air jet to each other in a state of being in parallel to each other. The fundamental configuration of the method resides in a production method of a carbon fiber precursor fiber bundle in which method a plurality of small tows, each made into a yarn in a state of being divided from each other, are housed in a container after the widthwise ends of the small tows have been loosely intermingled with each other. Preferably, when housed in a container, the small tows are taken up with a gear roll, a nip roll or the like, and are housed as they are in a container because the form of the fiber bundle is thereby made more stable.

Small tows adjacent to each other may be intermingled with each other by feeding a plurality of small tows, so that the small tows are adjacent and in parallel to each other, to a yarn channel of an intermingling device that includes a plurality of air jet holes disposed in the yarn channel having a flat rectangular sectional shape with a predetermined interval along the long side direction of this flat rectangular section, and by jetting out air from the air jet holes. Here, it should be noted that, in the present specification, the intermingling device that is used for producing an aggregate of tows by intermingling the small tows with each other is referred to as a second intermingling device, and the intermingling device, to be described below, that carries out intermingling inside a small tow is referred to as a first intermingling device.

Before intermingling small tows with each other, the width of a small tow itself can be controlled and the bundling property can be imparted to the small tow itself by beforehand passing the small tows through the first intermingling device. In this case, a desired tow width and a desired bundling property can be imparted to the small tow by passing the small tow through an air intermingling device that includes a yarn channel having a circular section and an air jet hole which opens into this yarn channel having the circular section and by jetting out air from the air jet hole, or by passing the small tow through an air intermingling device that includes a yarn channel having a flat rectangular section and a plurality of air jet holes which open into the yarn channel with a predetermined interval along the long side direction of this flat rectangular section and by jetting out air from the air jet holes.

In this case, the control of the width of the small tow and the securement of the bundling property of the small tow are carried out beforehand with the first intermingling device in a manner dedicated to the small tow; subsequently, for the purpose of bundling to unify the small tows with each other, the small tows are fed, so that the small tows are adjacent and in parallel to each other, to the second intermingling device, including a yarn channel having a flat rectangular section, that is disposed next to the first intermingling device, and thus the plurality of the small tows adjacent to each other, having been beforehand intermingled, can be bundled with each other into a unified article.

Alternatively, in the present invention, without particularly intermingling a small tow itself in advance, it is possible to intermingle the filaments in each of the adjacent small tows with each other and intermingle the adjacent small tows with each other simultaneously. In other words, in an aggregate-of-tows production step, the filaments within a small tow may be intermingled with each other. In this case, it is possible to intermingle the filaments within each of the small tows with each other and intermingle the adjacent small tows with each other simultaneously by feeding a plurality of small tows which have not been intermingled, so that the small tows are adjacent and in parallel to each other, to an intermingling device that includes a plurality of air jet holes disposed with predetermined intervals along the long side direction of a flat rectangular section of a yarn channel having a flat rectangular yarn channel sectional shape, and by jetting out air from these air jet holes.

In the yarn channel shape, having a flat rectangular section, to be used for intermingling the filaments with each other within a small tow, the dimension thereof may vary depending on the total fineness of the small tow, but is such that the dimension along the height direction, namely, the short side of the flat rectangular section is preferably 1 mm or more and 5 mm or less, and more preferably 2 mm or more and 4 mm or less. When the height is small, namely, the thickness of a tow is limited, the movement of the filaments due to air flow is restricted. This is disadvantageous from a view point that the degree of intermingle tends to decrease. On the contrary, when this dimension is large, the thickness of a tow becomes large although the thickness also depends on the long side dimension. This is disadvantageous from a view point that the degree of intermingle tends to decrease.

Figure 2:
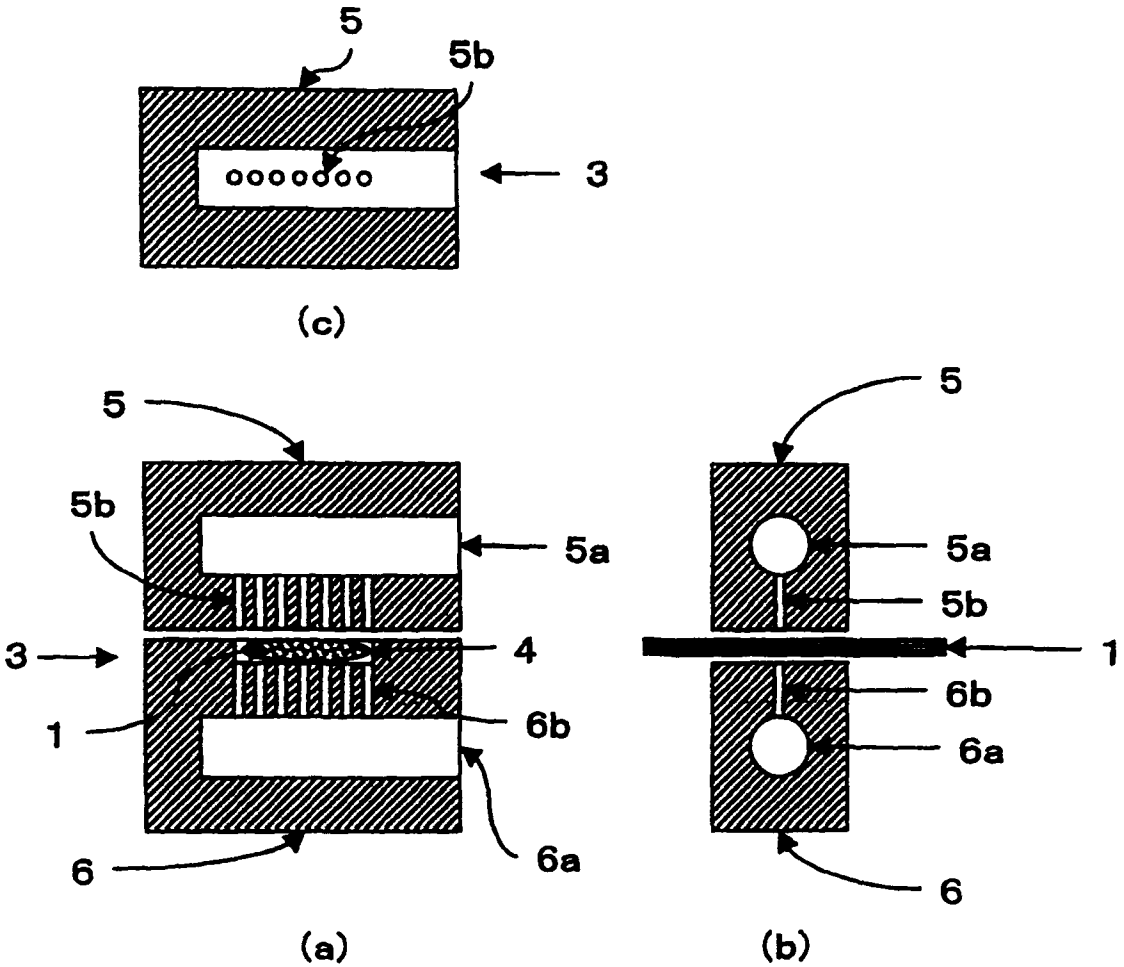
FIG. 2 is a schematic view illustrating an example of structure of a first intermingling device that carries out intermingling within a small tow by air jet, wherein (a) is a front sectional view as viewed from the direction of travel of the fiber bundle, (b) is a side sectional view, and (c) is a top sectional view.

An intermingling device has, for example, a structure shown in FIG. 2 which device can be used for intermingling filaments within a small tow with each other, and includes a yarn channel having a flat rectangular sectional shape and a plurality of air jet holes disposed with a predetermined interval along the long side direction of the flat rectangular sectional shape. As for the long side dimension, there is a preferable range from the viewpoint of controlling the total fineness of the small tow and the tow width. The numerical value representing such a preferable range is the value of the ratio D/L of the total fineness D (dTex) of the small tow 1 to the long side dimension L (mm) of the flat sectional yarn channel 4, and the ratio value is preferably 2000 dTex/mm or more and 12000 dTtex/mm or less. In this connection, the hole size (diameter) of each of the air jet holes 5*b* and 6*b* is preferably 0.3 mm or more and 1.2 mm or less, and more preferably 0.5 mm or more and 1.0 mm or less.

Further, from the viewpoint of obtaining uniform intermingling, the disposition of the air jet holes is preferably such that the holes are disposed with an even pitch of 0.8 mm or more and 1.6 mm or less. The length of the yarn channel 4, namely, the length of the intermingling device is preferably 10 mm or more and 40 mm or less. When this length exceeds 40 mm, it is disadvantageous from the viewpoint that there tends to occur disturbance or fluttering of tows probably ascribable to the disturbance of the ejected air flow at each of both ends of the yarn channel, and the intermingling tends to be nonuniform.

Figure 3:
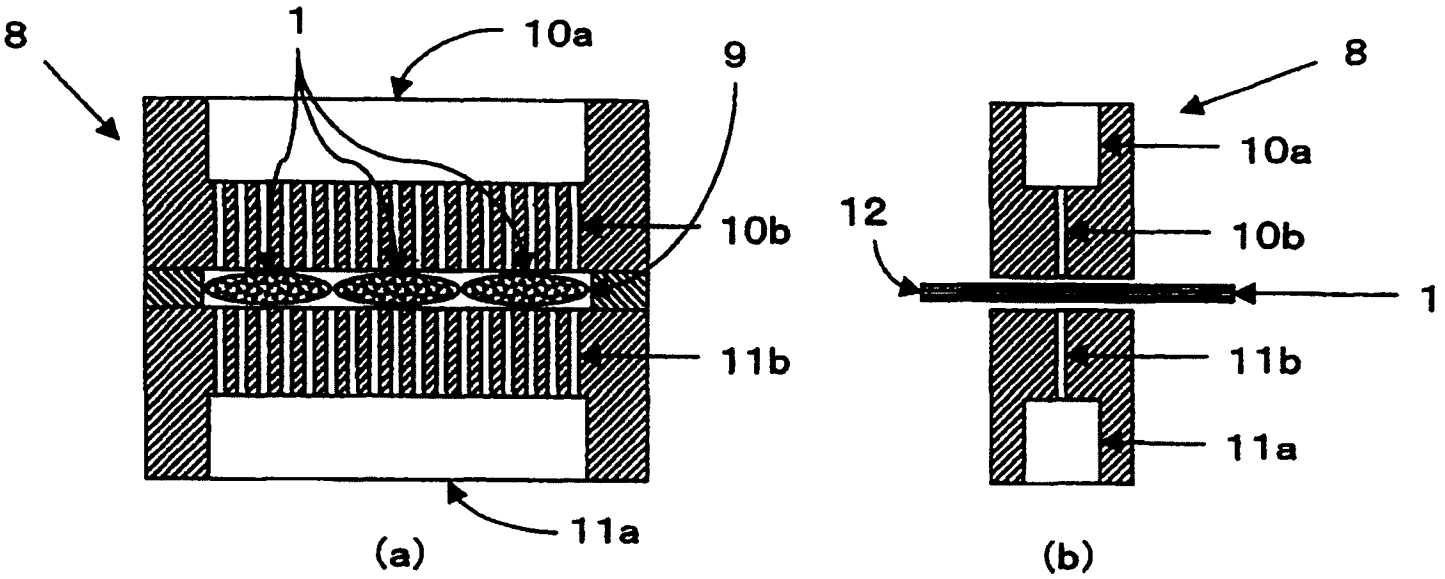
FIG. 3 is a schematic view illustrating an example of structure of a second intermingling device that carries out intermingling between small tows by air jet, wherein (a) is a front sectional view as viewed from the direction of travel of the fiber bundle and (b) is a side sectional view.

For the purpose of intermingling adjacent small tows with each other, a plurality of small tows may be fed, so that the small tows are adjacent to each other, to an intermingling device shown in FIG. 3 that includes a flat rectangular sectional shape of a yarn channel and a plurality of air jet holes disposed in this yarn channel with a predetermined interval along the long side direction of the flat rectangular shape. As for the long side dimension L of the flat rectangle, there is naturally a preferable range for the purpose of controlling the tow width by the total fineness of the small tows and the number of filaments (fibers) to be aggregated, namely, with respect to the total fineness of the aggregate of tows.

Specifically, the above range means the value of a ratio n·D/L of the total fineness nD (dTex) of an aggregate of tows represented by the product between the total fineness D (dTex) of the small tow and the number n of small tows to be aggregated to the long side dimension L (mm), and the value of the ratio is preferably 2000 dTex/mm or more and 12000 dTex/mm or less. In this connection, the hole diameter of each of the air jet holes is preferably 0.3 mm or more and 1.2 mm or less, and more preferably 0.5 mm or more and 1.0 mm or less.

Further, from the viewpoint of uniform intermingling, the disposition of the air jet holes is preferably such that the holes are disposed with an even pitch of 0.8 mm or more and 1.6 mm or less. The pitch for the air jet holes is preferably 0.8 mm or more from the viewpoint of suppressing the generation of disturbance or fluttering of tows due to ejected air flow, and is preferably 1.6 mm or less from the viewpoint of suppressing the generation of intermingling unevenness due to the revolution of monofilaments within a tow.

The length of the yarn channel, namely, the length of the intermingling device is preferably 10 mm or more and 40 mm or less. When this length exceeds 40 mm, it is disadvantageous from the viewpoint that there tends to occur disturbance or fluttering of tows probably ascribable to the disturbance of the ejected air flow at each of both ends of the yarn channel, and the intermingling tends to be nonuniform.

Figure 5:
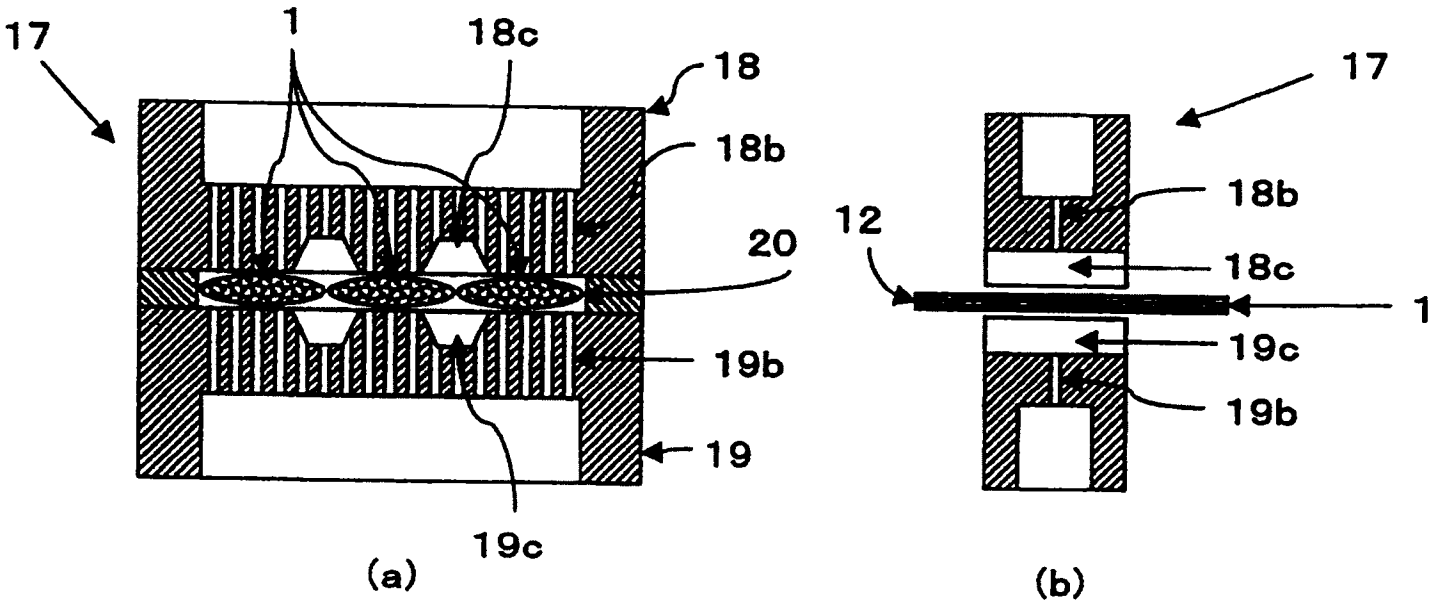
FIG. 5 is a schematic view illustrating an example of structure of a second intermingling device that has grooves and imparts confounding between small tows, wherein (a) is a front sectional view as viewed from the direction of travel of the fiber bundle and (b) is a side sectional view.

Further, in an intermingling device that includes a plurality of air jet holes disposed, in a yarn channel having a flat rectangular sectional shape of the yarn channel to intermingle adjacent small tows with each other, with a predetermined interval along the long side direction of the flat rectangular shape, there may be formed, as shown in FIG. 5, a groove extending along the lengthwise direction of the yarn channel at the position of the adjacent ends of the small tows to be aggregated. The provision of such a groove leads to formation of a space permitting free movement of the filaments at the adjacent ends of the small tows to be intermingled with each other in the flat rectangular sectional yarn channel, and hence the small tows adjacent to each other can be efficiently intermingled with each other.

Figure 8:
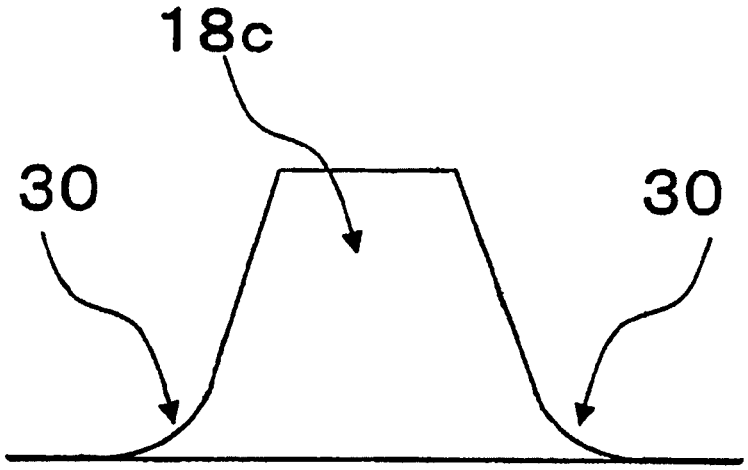
FIG. 8 is a schematic partial view illustrating the roundness R at an angular groove portion.

The sectional shape (across the fiber bundle passage direction) of such a groove may be a shape of a part of a circle such as a semicircle or a trapezoidal shape as shown in FIG. 5. In the case of a semicircular groove, if a portion in contact with filaments is angular, there is a possibility such an angular portion damages the tow. For the purpose of avoiding such a fear, it is preferable to provide a roundness R to the angular groove portion facing the yarn channel. It is more preferable to use a trapezoidal groove in place of a groove having a sectional shape of a part of a circle. Also in the case of a trapezoidal groove, it is preferable to provide a roundness R to the angular groove portion facing the yarn channel. FIG. 8 shows an example in which a roundness R 30 is provided to each of the angular portions facing the yarn channel in the trapezoidal groove 18*c* shown in FIG. 5. A similar roundness R may also be provided to the trapezoidal groove 19*c* provided on the downside of the yarn channel.

When the groove section is a part of a circle such as a semicircle, the size of a groove is preferably approximately 2 mm or more and 10 mm or less and more preferably 3 mm or more and 8 mm or less in terms of the diameter of the circle, and the depth of the groove is preferably approximately 1.5 mm or more and 4 mm or less. In the case of a trapezoidal groove, the long side dimension of a trapezoidal groove disposed on the long side portion of a flat yarn channel is preferably 2 mm or more and 10 mm or less and more preferably 3 mm or more and 8 mm or less, and the dimension of the short side corresponding to the groove bottom is preferably approximately 1.5 mm or more and 6 mm or less. The ends of small tows adjacent to each other are intermingled with each other in a groove, and hence an air jet hole is disposed so as to eject air into the interior of the groove. From the viewpoint of stable traveling of small tows and uniform intermingling, the disposition of such a hole is preferably such that holes are disposed in a bilaterally symmetric manner within the groove shape, or a hole is disposed on the central line in the bottom of the groove. This is conceivably because the provision of a groove in the yarn channel probably makes smooth the discharge of the ejected air from the intermingling device; there is also obtained an effect to stabilize the form and the traveling of the small tows traveling in a manner adjacent to each other on the entrance side of the intermingling device.

Figure 6:
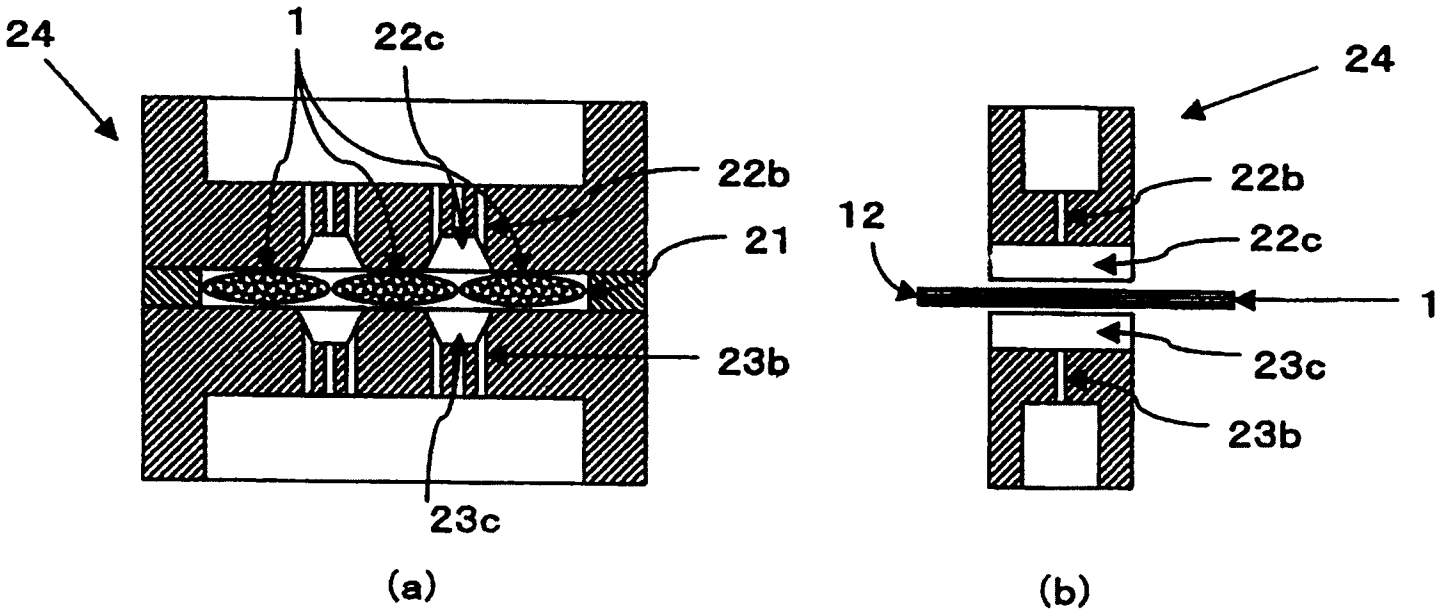
FIG. 6 is a schematic view illustrating an example of structure of a second intermingling device that has air jet holes only inside the grooves and imparts confounding between small tows, wherein (a) is a front sectional view as viewed from the direction of travel of the fiber bundle and (b) is a side sectional view.

Further, in the present invention, a nozzle having such a groove as described above may be a nozzle in which an air jet hole is disposed only in the groove as shown in FIG. 6. In this way, it becomes easy to more loosely intermingle the small tows with each other as compared with the intermingling of the filaments within a small tow to maintain a single tow form.

The carbon fiber precursor fiber bundle obtained as described above preferably has a fiber degree of intermingle between the small tows based of less than 1 $m^{-1}$ on the hook drop method. By setting the fiber degree of intermingle at less than 1 $m^{-1}$, it becomes easy to carry out division into small tows only by the tension generated in the flame retarding step or the carbonization step involved in the carbon fiber production step, a dividing guide bar or the like becomes unnecessary, damaging of tows and yarn breaking caused by scratching are thereby suppressed, and hence it becomes easy to make excellent the grade of the obtained carbon fiber.

In the present invention, small tows may be fed to an intra-small-tow intermingling device with regulating the yarn channel of a plurality of small tows so that the side ends of the small tows adjacent to each other may be in contact with each other by using a curved guide or the like, after intermingling the monofilaments within a small tow with each other.

The carbon fiber precursor fiber bundle bundled as described above may be once housed in a container as described before, and thereafter, may be taken out from the container to be guided into the flame retarding step or the carbonization step. When taken out, a form of an aggregate of tows is not collapsed. The carbon fiber precursor fiber bundle spontaneously divides into a plurality of small tows by the tension generated during the firing step. Thus stable firing can be carried out to yield a high-quality carbon fiber.

A carbon fiber obtained in the present invention is a carbon fiber having a strand strength (JIS R7601-1986) of 4100 MPa or more, preferably 4400 MPa or more, and more preferably 4900 MPa or more. When the strand strength is 4100 MPa or more, it becomes easy to apply such a carbon fiber to common industrial fields requiring high strength comparable with that of small tow.

The carbon fiber of the present invention can be obtained by firing the above described acrylonitrile-based precursor fiber bundle on the basis of the methods well known in the art. Preferred among these method is a method in which a carbon fiber precursor fiber bundle is subjected to a flame retarding treatment continuously while shrinkage thereof is being limited in a flame retarding oven having zones, where temperature of each zone is controlled at from 220° C. to 250° C. to make a temperature gradient from a lower temperature to a higher temperature over the oven; thus a flame retardant fiber yarn having a density of approximately 1.36 g/$cm^3$ is obtained; then a carbonization treatment is carried out for from 1 to 5 minutes, while shrinkage is being limited, in a carbonization furnace having a nitrogen atmosphere with a temperature distribution extending from 300° C. to 700° C.; and subsequently a carbonization treatment is carried out for from 1 to 5 minutes, while shrinkage is being limited, in a carbonization furnace having a nitrogen atmosphere with a temperature distribution extending from 1,000° C. to 1,300° C.

(Measurement Method of the Number of Adhered Monofilaments)

Identification of the adhesion between monofilaments can be carried out as follows: a precursor fiber bundle is cut approximately to 5 mm and dispersed in 100 mL of acetone, the dispersion is stirred for 1 minute at 100 rpm and then filtered with a black paper filter and the number of adhered monofilaments is measured.

(Measurement Method of the Size of a Crystal Region)

The size of a crystal region can be measured as follows. An acrylonitrile-based precursor fiber bundle is cut to 50 mm in length; 30 mg of the cut fibers is accurately weighed out as a sample; the cut sample fibers are aligned by pulling in such a way that the fiber axes of the cut sample fibers are accurately parallel to each other; then, the cut sample fibers are shaped by use of a sample shaping jig into a fiber sample bundle having a 1 mm width and a uniform thickness. The fiber sample bundle is impregnated with a methanol solution of vinyl acetate, coagulated in such a way that the form of the bundle is not collapsed, and then fixed on the sample stage of a wide angle X-ray diffractometer. As the X-ray source, a CuKα radiation (a Ni filter is used) X-ray generator manufactured by Rigaku Corporation is used. With aid of a goniometer manufactured by Rigaku Corporation a diffraction peak at around 2θ=17° corresponding to the plane indexes (100) of graphite is detected on the basis of the transmission method with a scintillation counter. The output is at 40 kV-100 mA in the measurement. From the half width of the diffraction peak, the size La of a crystal region is derived by using the following formula:

$$La=K\lambda/(\beta_0 \cos\theta)$$

wherein K denotes the Scherrer constant of 0.9, λ denotes the wavelength of the used X-ray (1.5418 Å because here is used CuKα ray), θ denotes the Bragg diffraction angle, $\beta_0$ denotes the true half width, and $\beta_0=\beta_E-\beta_1$ where $\beta_E$ is the apparent half width and $\beta_1$ is the apparatus constant and is, in this case, $1.05\times10^{-2}$ rad.

(Measurement Method of the Monofilament Strength)

The monofilament strength can be measured as follows. A monofilament automatic tensile strength/elongation tester (manufactured by Orientec Co., Ltd., trade name: UTM II-20) is used. A monofilament affixed on a board is secured in a load cell with a chuck and subjected to a tensile test at a rate of 20.0 mm/min and thus a strength and an elongation are measured.

(Measurement Method of the Fineness Unevenness (CV Value) of Monofilaments)

The fineness unevenness (CV value) of a monofilament can be measured as follows. A fiber of an acrylonitrile-based polymer to be measured is inserted into a vinyl chloride resin tube of 1 mm in inside diameter, and then the tube is cut into a round slice with a knife to prepare a sample. The sample is adhered on a SEM sample stage in such a way that the fiber section of the acrylonitrile-based polymer can be seen from upside, and then Au is sputtered on the sample to a thickness of approximately 10 nm. The sample thus obtained is subjected to an observation of the fiber section with a scanning electron microscope (manufactured by Philips, trade name: XL20 scanning electron microscope) under the conditions that the acceleration voltage is 7.00 kV and the operating distance is 31 mm, and thus, the fiber sectional area of the monofilament was measured randomly for approximately 300 monofilaments to derive the monofilament fineness.

$$CV\ \text{value}(\%)=(\text{Standard deviation/mean fineness})\times 100$$

wherein the standard deviation and the mean fineness are the standard deviation and the mean value of the above described finenesses.

(Measurement of the Lengthwise Directional Adhesion Unevenness of an Oiling Agent)

The lengthwise directional adhesion unevenness of an oiling agent can be measured as follows. Along the lengthwise direction of a precursor yarn, sampling is successively made with N (the number of samples)=10, and the samples are subjected to the measurement of the oiling agent adhesion unevenness with a wavelength dispersive fluorescent X-ray analyzer (manufactured by Rigaku Denki Kogyo Co., Ltd., trade name: ZSXmini).

(Measurement Method of Degree of Swelling)

The degree of swelling can be derived by using the mass w after the removal of the adhered liquid with a centrifugal separator (3000 rpm, 15 minutes) from a fiber bundle in a swollen state and the mass $w_0$ after drying the thus treated bundle with a hot air dryer at 105° C. for 2 hours, on the basis of the following formula: the degree of swelling (% by mass)=$(w-w_0)\times 100/w_0$.

(Measurement Method of Moisture Content)

The moisture content is a value (% by mass) obtained by using the mass w of a carbon fiber precursor fiber bundle in a wet state and the mass wo after drying the bundle with a hot air dryer at 105° C. for 2 hours, on the basis of the following formula: $(w-wo)\times 100/wo$.

(Evaluation Method of Degree of Intermingle)

The evaluation is made with a hook drop method. A tow is hooked with a load, at one end thereof, of 10 g/3000 denier (10 g/330 Tex) while the original form of the tow is being maintained. A string of wire of 1 mm in diameter crooked perpendicularly at a position of 20 mm away from the string tip is connected to a 10 g weight. The weight is hooked between tows and is allowed to fall freely. The falling distance thus obtained is represented by X m and the degree of intermingle is given by $$\text{Degree of intermingle}=1/X.$$

The measurement is repeated 30 times for a sample and 20 middle measurement values out of 30 values are adopted to derive an average value to be used.

EXAMPLES

Hereinafter, specific description will be made on the production of a small tow of the carbon fiber precursor fiber to be a target of the present invention on the basis of representative examples.

Example 1

Production Method (I) of a Small Tow

Acrylonitrile, acrylamide and methacrylic acid were subjected to copolymerization based on aqueous suspension polymerization in the presence of ammonium persulfate-ammonium hydrogen sulfite and iron sulfate, and there was obtained an acrylonitrile-based polymer composed of acrylonitrile unit/acrylamide/methacrylic acid unit=96/3/1 (mass ratio). The acrylonitrile-based polymer was dissolved in dimethylacetamide to prepare a 21% by mass spinning solution.

The spinning solution was extruded through a spinneret of 50,000 in hole number and 45 μm in hole diameter into a coagulation bath composed of an 60% by mass aqueous solution of dimethylacetamide at 35° C. to prepare a coagulated yarn, and the coagulated yarn was taken up at a take-up speed of 0.40 times the extruding speed of the spinning solution.

Then, the fiber thus obtained was subjected to wet heat drawing at a magnification of 5.4 while simultaneously carrying out washing in hot water, guided into a first oil bath of an aminosilicon-based oiling agent of 1.5% by mass to be imparted with the first oiling agent, once squeezed with a few guides, and subsequently imparted with a second oiling agent in a second oil bath of an aminosilicon-based oiling agent of 1.5% by mass. The fiber was dried with a hot roll, and secondarily drawn between hot rollers at a magnification of 1.3 to result in a total drawing magnification of 7.0. Thereafter, the moisture content of the fiber was regulated with a touch roll to yield a carbon fiber precursor fiber bundle (small tow) having a monofilament fineness of 1.2 dtex.

Three small tows 1, the carbon fiber precursor fiber bundles, obtained as described above were used. As shown in FIG. 1, with a spray 2, ion-exchanged water was imparted to each of the small tows, and thereafter, the three small tows 1 were fed respectively to three first intermingling devices 3 shown in FIG. 2 each of which gives intermingling to each small tow. Each of the intermingling devices 3 for the respective small tows 1 had a structure shown in FIG. 2. In other words, the first intermingling device 3 had an upper nozzle 5 and a lower nozzle 6 having a flat rectangular yarn channel 4 passing through in the traveling direction of the tow in the central portion of the nozzles. The upper and lower nozzles 5 and 6 each had a vertically symmetric structure in a manner sandwiching the yarn channel 4, respectively had the compressed air introduction parts 5*a* and 6*a*, and respectively had many air jet holes 5*b* and 6*b* that were communicatively connected respectively to the compressed air introduction parts 5*a* and 6*a* and had the openings thereof on the facing sides along the air introduction directions. The yarn channel width of the yarn channel 4 was 8 mm, the yarn channel height was 3 mm, and the yarn channel length (in the traveling direction of the small tow) was 20 mm. The jet opening diameter of each of the air jet holes 5*b* and 6*b* was 1 mm, the disposition pitch thereof was set at 1.5 mm. The pressure of the fed air was set at 50 kPa-G (G indicating the gauge pressure).

The three small tows 1 respectively intermingled with the three first intermingling devices 3 were pulled and aligned, once made to pass through a driving roll 7, and fed to a second intermingling device 8 to intermingle the adjacent small tows 1 with each other. The second intermingling device 8 had a structure shown in FIG. 3. The fundamental structure thereof was similar to that of the first intermingling device 3 dedicated to the small tow; however, because the small tows 1 were respectively intermingled beforehand, the width of the yarn channel 9 was larger by a factor of 3 or more than that of the first intermingling device, and the height of the yarn channel thereof was set to be slightly lower than that of the first intermingling device 3.

Incidentally, in the second intermingling device 8, the yarn channel width was set at 24 mm, the yarn channel height was set at 2.5 mm, the yarn channel length was set at 20 mm, the opening diameter of each of the air jet holes 10*b* and 11*b* was set at 0.5 mm, the disposition pitch thereof was set at 0.8 mm, and the pressure of the air to be fed to the compressed air introduction parts 10 *a* and 11*a* was set at 300 kPa-G. One carbon fiber precursor fiber bundle thus obtained was fed to a gear roll 13 to be taken up, and then placed as it was in a container 15 through a chute 14. When housed in the container 15, the carbon fiber precursor fiber bundle 12 had a form of a single tow (aggregate of tows) in which three small tows were aggregated. At this time, namely, after being housed in the container, the moisture content of the carbon fiber precursor fiber bundle 12 was 2% by mass. By the gear roll 13 used when placed in the container 15, wave was imparted to the obtained tow. The distance between a crest of the wave and an adjacent crest was 25 mm. The degree of intermingle of the carbon fiber precursor fiber bundle 12 thus obtained was evaluated and found to be less than 1 $m^{-1}$ (The evaluation was carried out with a test length of 1 m, and any of the 10 g loads fell with a falling distance of 1 m or more, so that the measurement was impossible.)

The carbon fiber precursor fiber bundle 12 thus obtained was taken out from the container 15, and was fed to the flame retarding step without dividing into small tows, subjected to a flame retarding treatment for 70 minutes, and further subjected to a carbonization treatment for 3 minutes in the carbonization step. When the carbon fiber precursor fiber bundle was taken out from the container, the bundle was once pulled upward in such a way that the bundle was made to pass through guide bars plural times, so that the small tows were pulled and aligned. The carbon fiber precursor fiber bundle thus aligned by pulling was fed to the flame retarding step without dividing into the small tows.

In the course of these operations, the rolls used for traveling the tow were all flat rolls. Absolutely, neither division into small tows nor control of the form of the tow using a roll having a groove on the surface thereof or the like was carried out. In the flame retarding step, as the reaction proceeded, division into small tows occurred spontaneously without using dividing guides or the like. The carbon fiber bundle obtained after the carbonization treatment was free from fuzz and excellent in grade. The strand strength of the obtained carbon fiber was 4900 MPa.

Example 2

Figure 4:
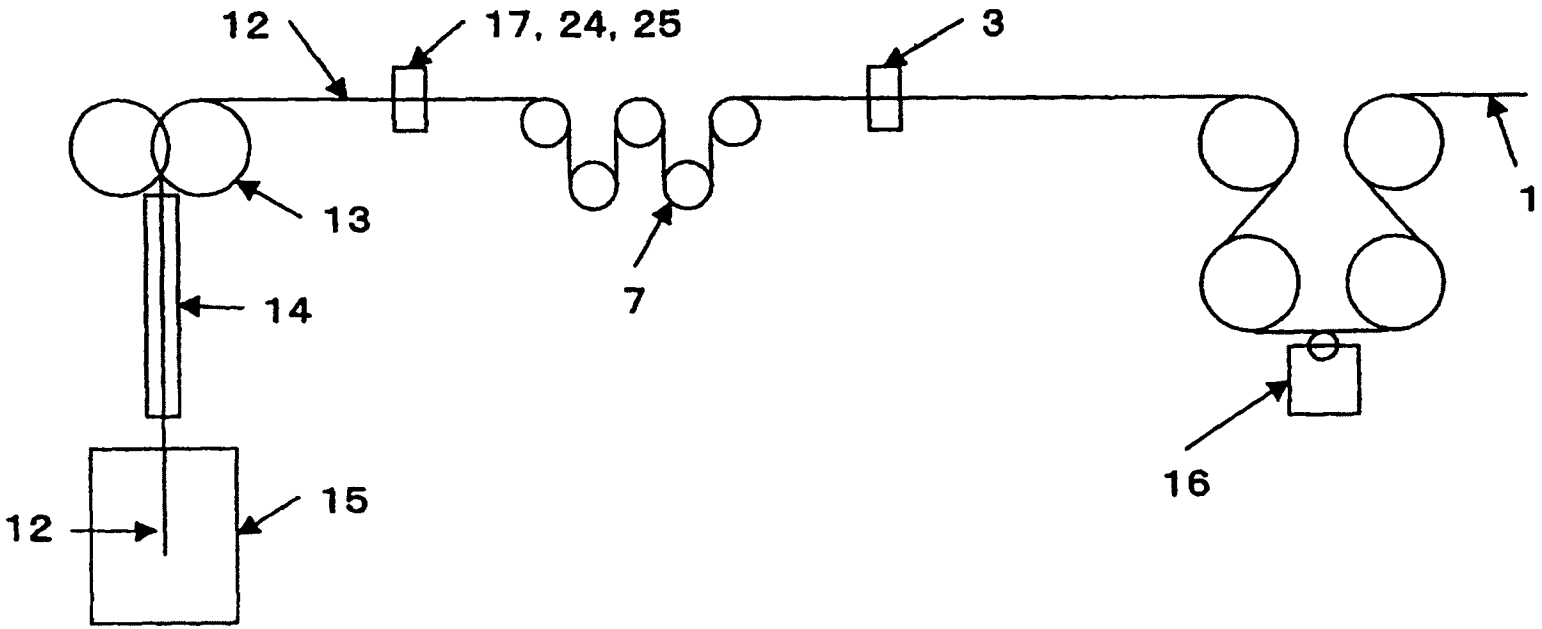
FIG. 4 is a schematic process drawing illustrating another example of a production process of a carbon fiber precursor fiber bundle in which process confounding is imparted by air jet.

As shown in FIG. 4, with a touch roll 16, ion-exchanged water was imparted to small tows 1, each having 50,000 filaments, obtained in the same manner as in Example 1, and then each of the small tows 1 was separately fed to a first intermingling device 3 shown in FIG. 2. The fundamental structure of the first intermingling device 3 dedicated to a small tow was similar to that in Example 1: the yarn channel width was 16 mm to be twice as wide as that in Example 1, the yarn channel height was 2.5 mm to be slightly smaller than that in Example 1, the yarn channel length was 20 mm to be the same as that in Example 1, the opening diameter of each of the air jet holes 5*b* and 6*b* was 1 mm to be the same as that in Example 1, and the disposition pitch thereof was set at 1.0 mm. The pressure of the fed air was set at 100 kPa-G to be twice as large as that in Example 1.

Subsequently, the three small tows 1 thus obtained were aligned by pulling and fed to a second intermingling device having a structure as shown in FIG. 5 which device intermingled adjacent small tows 1 with each other.

The second intermingling device 17 was different from the intermingling device 8 shown in FIG. 3 in that the yarn channel 9 had simply a flat rectangular section, but the upper and lower nozzles 18 and 19 of the second intermingling device 17 applied to present Example further included grooves 18*c* and 19*c* each having a trapezoidal section, respectively, above and below each of the portions in the flat rectangular section which portions corresponded to the abutting positions of the three small tows 1 adjacent to each other. The other aspects of the structure of the second intermingling device 17 were substantially the same as those in Example 1. In present Example, the second intermingling device 17 had the following dimension: the width of the yarn channel 20 was 45 mm to be wider by 21 mm than that in Example 1, the yarn channel height was 2.5 mm to be the same as that in Example 1, the opening diameter of each of the air jet holes 18*b* and 19*b* was 0.5 mm to be the same as that in Example 1, the disposition pitch thereof was 1.0 mm, the length of the long side of the trapezoidal grove section was 7 mm, and the length of the short side corresponding to the groove bottom was 3 mm. The pressure of the fed air was set at 200 kPa-G to be ⅔ that in Example 1. The carbon fiber precursor fiber bundle 12 thus obtained was fed to the gear roll 13 adjunct to a transfer device to be placed in a container 15 through a chute 14. In this case, the moisture content of the bundle after being housed was 2% by mass.

The carbon fiber precursor fiber bundle 12, leaving the second intermingling device 17, had a form of a single tow in which three small tows 1 were aggregated. By the gear roll 13 adjunct to the transfer device, wave was imparted to the carbon fiber precursor fiber bundle 12 placed in the container 15. The distance between a crest of the wave and an adjacent crest was 25 mm. The degree of intermingle of the carbon fiber precursor fiber bundle thus obtained was evaluated and found to be less than 1 $m^{-1}$. (The evaluation was carried out with a test length of 1 m, and any of the 10 g loads fell with a falling distance of 1 m or more, so that the measurement was impossible.)

In the same manner as in Example 1, the carbon fiber precursor fiber bundle 12 thus obtained was taken out from the container 15, and was fed to the flame retarding step without dividing into small tows, subjected to a flame retarding treatment for 70 minutes, and further subjected to a carbonization treatment for 3 minutes in the carbonization step. In the course of these operations, the rolls used for traveling the carbon fiber precursor fiber bundle 12 were all flat rolls. Absolutely, neither division into small tows nor control of the form of the tows using a roll having a groove on the surface thereof or the like was carried out. In the flame retarding step, as the reaction proceeded, division into small tows occurred spontaneously without using dividing guides or the like. The carbon fiber obtained after the carbonization treatment was free from fuzz and excellent in grade. The strand strength of the obtained carbon fiber was 4900 MPa.

Example 3

There was used a second intermingling device 24 shown in FIG. 6, to intermingle small tows 1 with each other, having the same structure as that in Example 2 except that a plurality of air jet holes 22*b* and 23*b* were formed in the grooves 22*c* and 23*c* communicatively connected to a yarn channel 21, but no air jet holes were formed in the portions other than the grooves. Using this second intermingling device, a carbon fiber precursor fiber bundle having a form of a single tow in which three small tows were aggregated was obtained in the same manner as in Example 2. One carbon fiber precursor fiber bundle thus obtained was fed to a gear roll 13 to be taken up, and then placed as it was in a container 15 through a chute 14. At this time, namely, after being housed in the container, the moisture content was 4% by mass. When housed in the container 15, the carbon fiber precursor fiber bundle 12 had a form of a single tow in which three small tows 1 were aggregated. At this time, namely, after being housed in the container, the moisture content of the carbon fiber precursor fiber bundle 12 was 2% by mass. By the gear roll 13 used when placed in the container 15, wave was imparted to the obtained tow. The distance between a crest of the wave and an adjacent crest was 25 mm. The degree of intermingle of the carbon fiber precursor fiber bundle 12 thus obtained was evaluated and found to be less than 1 $m^{-1}$. (The evaluation was carried out with a test length of 1 m, and any of the 10 g loads fell with a falling distance of 1 m or more, so that the measurement was impossible.)

In the same manner as in Example 1, the carbon fiber precursor fiber bundle 12 thus obtained was taken out from the container 15, and was fed to the flame retarding step without dividing into small tows, subjected to a flame retarding treatment for 70 minutes, and further subjected to a carbonization treatment for 3 minutes in the carbonization treatment step.

In the course of these operations, the rolls used for traveling the tow were all flat rolls. Absolutely, neither division into small tows nor control of the form of the tow using a roll having a groove on the surface thereof or the like was carried out. In the flame retarding step, as the reaction proceeded, division into small tows occurred spontaneously without using dividing guides or the like. The carbon fiber bundle obtained after the carbonization treatment was free from fuzz and excellent in grade. The strand strength of the obtained carbon fiber was 4900 MPa.

Example 4

Figure 7:
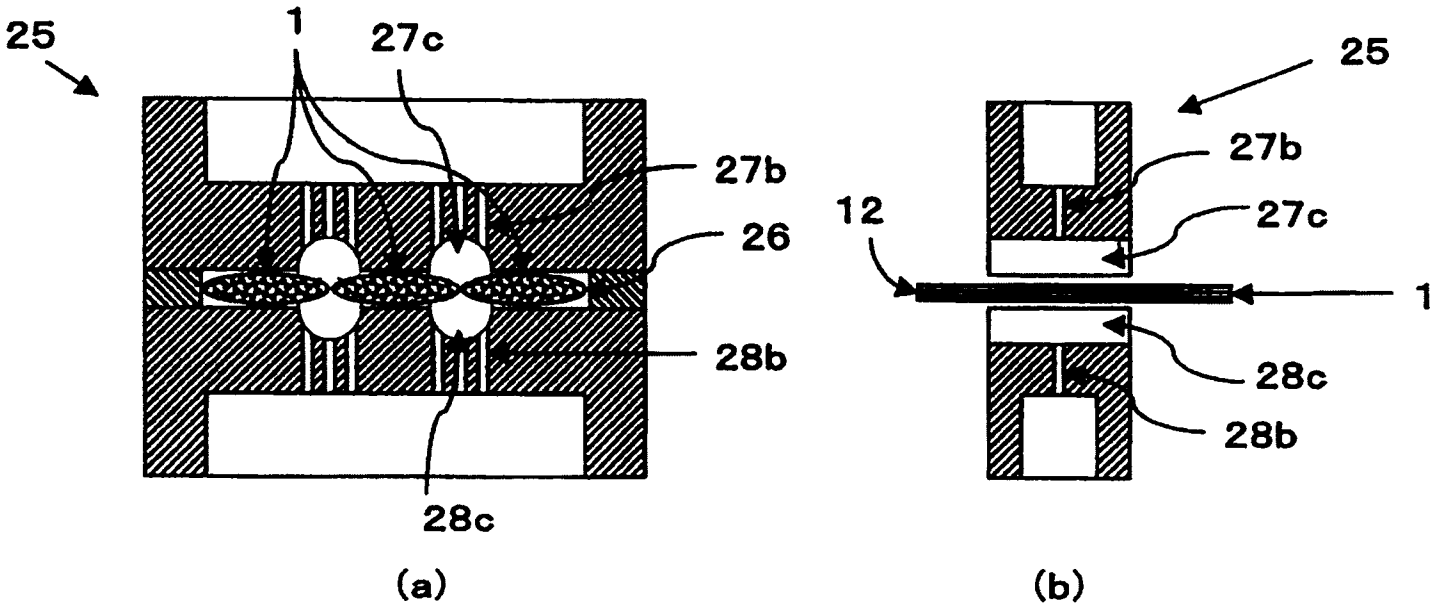
FIG. 7 a schematic view illustrating another example of a second intermingling device that has air jet holes only inside the grooves and imparts confounding between small tows, wherein (a) is a front sectional view as viewed from the direction of travel of the fiber bundle and (b) is a side sectional view.

A carbon fiber precursor fiber bundle 12 was placed in a container 15 through the same intermingling procedures as in Example 3 except that an intermingling device 25 having a structure shown in FIG. 7 was used as the second intermingling device to intermingle adjacent small tows with each other. The second intermingling device 25 was the same as the intermingling device of Example 3 (FIG. 6) except that grooves 27*c* and 28*c*, each having a semicircular section the diameter of which was 6 mm and having a grove depth of 3 mm, respectively, were formed above and below each of the portions which corresponded to the abutting positions of the three small tows 1 in the flat rectangular section of a yarn channel 26; the small tows were intermingled with each other by jetting out air from a plurality of air jet holes 27*b* and 28*b* in the same manner as in Example 3.

The degree of intermingle of the carbon fiber precursor fiber bundle thus obtained was evaluated and found to be less than 1 $m^{-1}$. (The evaluation was carried out with a test length of 1 m, and any of the 10 g loads fell with a falling distance of 1 m or more, so that the measurement was impossible.)

In the same manner as in Example 1, the carbon fiber precursor fiber bundle 12 thus obtained was taken out from the container 15, and was fed to the flame retarding step without dividing into small tows, subjected to a flame retarding treatment for 70 minutes, and further subjected to a carbonization treatment for 3 minutes in the carbonization step. In the course of these operations, the rolls used for traveling the tow were all flat rolls. Absolutely, neither division into small tows nor control of the form of the tow using a roll having a groove on the surface thereof or the like was carried out. In the flame retarding step, as the reaction proceeded, division into small tows started to occur spontaneously without using dividing guides or the like. The carbon fiber obtained after the carbonization treatment was perfectly divided into small tows, free from fuzz and excellent in grade. The strand strength of the obtained carbon fiber was 5100 MPa.

Example 5

A carbon fiber precursor fiber bundle was placed in a container 15 in the same manner as in Example 4 except that a nip roll having a flat surface was used in place of the gear roll 13 in Example 4. Thereafter, a carbon fiber strand was obtained in the same manner as in Example 4 (Example 1).

When housed in the container 15, the carbon fiber precursor fiber bundle 12 had a form of a tow in which three small tows 1 were aggregated. At this time, the moisture content of the carbon fiber precursor fiber bundle 12 was 2% by mass.

The degree of intermingle of the carbon fiber precursor fiber bundle 12 thus obtained was evaluated and found to be less than 1 $m^{-1}$. (The evaluation was carried out with a test length of 1 m, and any of the 10 g loads fell with a falling distance of 1 m or more, so that the measurement was impossible.)

In the same manner as in Example 1, the carbon fiber precursor fiber bundle 12 thus obtained was taken out from the container 15, and was fed to the flame retarding step without dividing into small tows, subjected to a flame retarding treatment for 70 minutes, and further subjected to a carbonization treatment for 3 minutes in the carbonization step.

In the course of these operations, the rolls used for traveling the tow were all flat rolls. Absolutely, neither division into small tows nor control of the form of the tow using a roll having a groove on the surface thereof or the like was carried out. In the flame retarding step, as the reaction proceeded, division into small tows occurred spontaneously without using dividing guides or the like. The carbon fiber bundle obtained after the carbonization treatment was free from fuzz and excellent in grade. The strand strength of the obtained carbon fiber was 4900 MPa.

Example 6

A carbon fiber strand was obtained in the same manner as in Example 1 except that the total drawing magnification was set at 9.

Example 7

A carbon fiber strand was obtained in the same manner as in Example 1 except that the nozzle hole diameter was set at 75 μm and the total drawing magnification was set at 9.

Comparative Example 1

A small tow obtained by the production method (I) of a small tow was used, and intermingling within the small tow was carried out in the same manner as in Example 1. Three small tows thus obtained was fed to a crimp-imparting device, which is not shown in the drawings, and bundled by crimping. The bundled tow was housed in a container in the same manner as in Example 1.

The carbon fiber precursor fiber bundle thus obtained was taken out from the container, and was subjected to a flame retarding treatment for 70 minutes, and further subjected to a carbonization treatment for 3 minutes. When the carbon fiber precursor fiber bundle was taken out from the container, the bundle was once pulled upward, in the same manner as in Example 5, in such a way that the bundle was made to pass through guide bars plural times, so that the small tows were aligned by pulling. The carbon fiber precursor fiber bundle thus aligned by pulling was fed to the flame retarding step without dividing into small tows, subjected to a flame retarding treatment for 70 minutes, and further subjected to a carbonization treatment for 3 minutes. In the course of these operations, the rolls used for traveling the tow were all flat rolls. Absolutely, neither tow division nor control of the form of the tow using a roll having a groove on the surface thereof or the like was carried out. In the flame retarding step, as the reaction proceeded, division into small tows occurred spontaneously without using dividing guides or the like. However, the carbon fiber obtained after the carbonization treatment was abundant in fuzz and not excellent in grade. In the flame retarding step, there frequently occurred winding around rolls conceivably ascribable to the fuzz. Additionally, the strand strength of the obtained carbon fiber was 3600 MPa.

The invention claimed is:

1. A production method of a carbon fiber precursor fiber bundle, characterized by comprising:

a coagulation step of forming swollen yarn by extruding an organic solvent solution of an acrylonitrile-based polymer into an aqueous solution of dimethylacetamide from a spinning nozzle having a nozzle hole diameter of 45 μm or more and 75 μm or less and the number of holes of 50,000 or more at a coagulated yarn take-up speed/extrusion linear speed ratio of 0.8 or less;

a wet heat drawing step of wet heat drawing the swollen yarn;

an oiling agent imparting step of imparting a first oiling agent to the wet heat drawn yarn by guiding the heat wet drawn yarn into a first oil bath, and subsequently imparting a second oiling agent in a second oil bath after once squeezing the yarn by use of two or more guides;

a small tow production step of obtaining a small tow by drying, densifying and secondarily drawing the yarn imparted with the first and second oiling agents so as to have a total drawing magnification of 5 or more and 10 or less; and an aggregate-of-tows production step of obtaining an aggregate of tows by feeding a plurality of the small tows so as to be in parallel and so that side ends of the small tows adjacent to each other are in contact with each other into an intermingling device that comprises a yarn channel having a flat rectangular section and a plurality of air jet holes which are disposed with a predetermined interval along the long side direction of the flat rectangle and which open into the yarn channel, and by jetting out air from the air jet holes to intermingle the adjacent small tows with each other.

2. The production method of a carbon fiber precursor fiber bundle according to claim 1, further comprising an aggregate-of-tows housing step of housing the aggregate of tows in a container after the aggregate-of-tows production step and a water imparting step of imparting water to the small tows before the aggregate-of-tows production step, wherein the water content of the aggregate of tows in the aggregate-of-tows housing step is set at less than 10% by mass.

3. The production method of a carbon fiber precursor fiber bundle according to claim 1, further comprising, before the aggregate-of-tows production step, an intra-small-tow intermingling step of intermingling monofilaments within the small tow with each other by passing the small tow through an intermingling device, other than the intermingling device used in the aggregate-of-tows production step, that comprises a yarn channel having a circular section and an air jet hole which opens into this yarn channel, and by jetting out air from this air jet hole.

4. The production method of a carbon fiber precursor fiber bundle according to claim 1, further comprising, before the aggregate-of-tows production step, an intra-small-tow intermingling step of intermingling the monofilaments within the small tow with each other by passing the small tow through an intermingling device, other than the intermingling device used in the aggregate-of-tows production step, that comprises a yarn channel having a flat rectangular section and a plurality of air jet holes which are disposed with a predetermined interval along the long side direction of this flat rectangle and which open into this yarn channel, and by jetting out air from these air jet holes.

5. The production method of a carbon fiber precursor fiber bundle according to claim 1, wherein monofilaments within the small tow are intermingled with each other in the aggregate-of-tows production step.

6. The production method of a carbon fiber precursor fiber bundle according to claim 5, wherein the intermingling device, used in the aggregate-of-tows production step, further comprises a groove which extends along the lengthwise direction of the yarn channel and which opens into the yarn channel at a position where the small tows are adjacent to each other.

7. The production method of a carbon fiber precursor fiber bundle according to claim 3, wherein:

the intermingling device, used in the aggregate-of-tows production step, further comprises a groove which extends along the lengthwise direction of the yarn channel and which opens into the yarn channel at a position where the small tows are adjacent to each other, and the air jet holes open only into the groove; and a plurality of the small tows are intermingled with each other, wherein the filaments within the small tows are intermingled with each other, by feeding to this intermingling device the plurality of the small tows having been subjected to the intra-small-tow intermingling step.

8. The production method of a carbon fiber precursor fiber bundle according to claim 1, further comprising a step of housing in a container the aggregate of tows obtained in the aggregate-of-tows production step after the aggregate of tows has been fed to a gear roll.

9. The production method of a carbon fiber precursor fiber bundle according to claim 1, further comprising a step of housing in a container the aggregate of tows obtained in the aggregate-of-tows production step after the aggregate of tows has been fed to a nip roll.

10. A production method of a carbon fiber precursor fiber bundle, characterized by comprising a step of obtaining a single aggregate of tows by disposing a plurality of small tows of carbon fiber precursor fiber so as to be in parallel and so that side ends of the small tows adjacent to each other are in contact with each other, and by intermingling the adjacent small tows with each other by air flow.

11. The production method of a carbon fiber precursor fiber bundle according to claim 10, wherein, in the step of obtaining an aggregate of tows, the intermingling is carried out by feeding a plurality of the small tows so as to be in parallel and adjacent to each other into an intermingling device that comprises a yarn channel having a flat rectangular section and a plurality of air jet holes which are disposed with a predetermined interval along the long side direction of the flat rectangle and which open into the yarn channel, and by jetting out air from the air jet holes.

* * * * *